US008170432B2

(12) United States Patent
Takeuchi

(10) Patent No.: US 8,170,432 B2
(45) Date of Patent: May 1, 2012

(54) IMAGE FORMING APPARATUS

(75) Inventor: Yasushi Takeuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 12/568,992

(22) Filed: Sep. 29, 2009

(65) Prior Publication Data

US 2010/0080591 A1 Apr. 1, 2010

(30) Foreign Application Priority Data

Oct. 1, 2008 (JP) ..... 2008-256415

(51) Int. Cl.
*G03G 15/00* (2006.01)

(52) U.S. Cl. ..... 399/49; 399/66; 399/92; 399/93

(58) Field of Classification Search ..... 399/49, 399/66, 92, 93
See application file for complete search history.

(56) References Cited

U.S. PATENT DOCUMENTS

| | | | | |
|---|---|---|---|---|
| 6,167,211 | A * | 12/2000 | Oogi et al. | 399/53 |
| 6,321,044 | B1 | 11/2001 | Tanaka | 399/49 |
| 6,665,502 | B2 | 12/2003 | Hirobe et al. | 399/49 |
| 6,856,773 | B2 | 2/2005 | Hirobe et al. | 399/49 |
| 7,286,784 | B2 * | 10/2007 | Tanaka | 399/92 |
| 7,587,154 | B2 * | 9/2009 | Sakai et al. | 399/92 |
| 2001/0026696 | A1 * | 10/2001 | Yokota et al. | 399/57 |

FOREIGN PATENT DOCUMENTS

| | | | |
|---|---|---|---|
| JP | 03-238482 | A | 10/1991 |
| JP | 07-061730 | B2 | 7/1995 |
| JP | 2001-100597 | A | 4/2001 |
| JP | 2002-062697 | A | 2/2002 |

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

An image forming apparatus includes a rotatable image bearing member on which a toner image is to be formed; a transferring device for transferring the toner image onto a transfer material at a transfer position; a separating member, disposed downstream of the transfer position with respect to a rotational direction of the image bearing member so as to contact the image bearing member, for separating the transfer material from the image bearing member; a density detecting device, disposed downstream of the transfer position with respect to the rotational direction of the image bearing member, for detecting a density of an image for density detection formed on the image bearing member; and an air moving device for moving air in the image forming apparatus in a direction of a rotation shaft of the image bearing member; wherein the density detecting device is disposed upstream of the separating member with respect to a direction of air movement by the air moving device.

4 Claims, 10 Drawing Sheets

| | EMB.1 | COMP. EMB.1 | COMP. EMB.2 | COMP. EMB.3 | COMP. EMB.4 |
|---|---|---|---|---|---|
| POSITION OF DEVICE | MOST UP-STREAM | BETWEEN CLAWS | MOST DOWN-STREAM | MOST UP-STREAM | MOST DOWN-STREAM |
| STATE OF FAN | OPERATED | OPERATED | OPERATED | STOPPED | OPERATED |
| SHIELDING MEMBER | NOT USED | NOT USED | NOT USED | NOT USED | USED |

(a)

(b)

IMAGE FORMING APPARATUS

FIELD OF THE INVENTION AND RELATED ART

The present invention relates to an image forming apparatus of an electrophotographic type, particularly an image forming apparatus such as a copying machine, a printer, a facsimile machine, or the like.

As described in Japanese Laid-Open Patent Application (JP-A) Hei 3-238482, an image forming apparatus including a separation claw for separating a transfer material (a recording material) in contact with a photosensitive member (an image bearing member) has been known. This separation claw is provided in a plurality of separation claw portions arranged between a transfer means and a cleaning means and extending in a line with respect to a direction of a rotation shaft of the photosensitive member.

In recent years, an improvement in image quality that approaches a photographic image quality and such a technique that meets speed-up coming close to that of a printing machine have been desired. In order to achieve the speed-up and the image quality improvement, maintenance off stability in coloring and density uniformity is a problem to be solved.

In order to solve this problem, as described in JP-A 2002-62697, a technique in which a detection image for density detection is formed on a photosensitive drum (member) and a reflection density of the detection image is optically detected by using a density detecting means and than a detection result is fed back to an image control to maintain a stable image is used. The density detecting means is constituted by, e.g., a light-emitting portion for emitting light and a light receiving portion for receiving the light emitted from the light-emitting portion so that a density can be judged based on a detected light amount by the light receiving portion.

In the constitution of JP-A 2002-62697, the density detecting means is disposed downstream of a transfer position in which a toner image on the photosensitive drum is to be transferred and upstream of a cleaning means for collecting untransferred toner, with respect to a rotational direction of the photosensitive drum. This may be attributable to various cases including, e.g., the case where there is no locating space of the density detecting means when a pretransfer charging means for enhancing a charge polarity of the toner is disposed upstream of the transfer position with respect to the rotational direction of the photosensitive drum and the case where there is also no locating space of the density detecting means when a pretransfer guide or the like for guiding the transfer material to the transfer position.

Incidentally, when both a separation claw and such a density detecting means are disposed downstream of the transfer position and upstream of the cleaning means and upstream of the cleaning means, toner contamination at a detection surface of the density detecting means occurs considerably, thus resulting in a problem such that accurate density detection cannot be performed.

This may be attributable to the following reason.

Generally, the toner image during transfer is subjected to electric discharge of an opposite polarity to a triboelectric charge polarity of the toner itself, so that untransferred toner left on the surface of the photosensitive member after the transfer contains a large amount of a toner component decreased in charge amount. For that reason, the untransferred toner has a weak mirror force with respect to the photosensitive member and is liable to be separated from the photosensitive member surface by a centrifugal force due to rotation or by air flow in the neighborhood of the photosensitive member, so that scattering toner particles are liable to be suspended in the air in an area subsequent to the transfer position and preceding a position of the cleaning means. Therefore, compared with a constitution in which the density detecting means is disposed upstream of the transfer position with respect to the rotational direction, the toner contamination is liable to occur. Moreover, the untransferred toner passes through a contact portion between the photosensitive drum and the separation claw to be separated from the photosensitive drum, so that a part of the untransferred toner is suspended, as the scattering toner, in the air in the neighborhood of the separation claw. The thus resulting large amount of suspended or scattering toner is deposited on the detection surface of the density detecting means, so that the problem that accurate density detection cannot be performed arises.

In order to prevent the deposition of the toner on the density detecting means, a constitution as described in JP-A 2001-100597 has been proposed. The constitution of JP-A 2001-100597 in such that a mechanism for covering the detection surface of the density detecting means with a shielding member (shutter) during a period other than a detecting operation period, thus preventing the toner deposition.

However, in the constitution of JP-A 2001-100597, redundant space and cost for or for disposing a solenoid or a motor for controlling opening/closing of the shutter or a circuit board for controlling these members are required. Further, in the case where the shutter falls into an improper operation due to some reason, the scattering toner was deposited on the density detecting means in a short period, so that there was a possibility that improper control was caused to occur.

SUMMARY OF THE INVENTION

A principal object of the present invention is to provide an image forming apparatus capable of preventing toner contamination of a density detecting means.

According to an aspect of the present invention is to provide an image forming apparatus comprising:

a rotatable image bearing member on which a toner image is to be formed;

a transferring device for transferring the toner image onto a transfer material at a transfer position;

a separating member, disposed downstream of the transfer position with respect to a rotational direction of the image bearing member so as to contact the image bearing member, for separating the transfer material from the image bearing member;

a density detecting device, disposed downstream of the transfer position with respect to the rotational direction of the image bearing member, for detecting a density of an image for density detection formed on the image bearing member; and an air moving device for moving air in the image forming apparatus in a direction of a rotation shaft of the image bearing member;

wherein the density detecting device is disposed upstream of the separating member with respect to a direction of air movement by the air moving device.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described based on embodiments with reference to the drawings. In the following description, unless otherwise specified, various constitutions of the image forming apparatus of the present invention can be replaced with known constitutions having the same functions within the scope of the present invention. That is, unless otherwise specified, the present invention is not limited to the constitutions described in the following embodiments.

Embodiment 1

Figure 2:
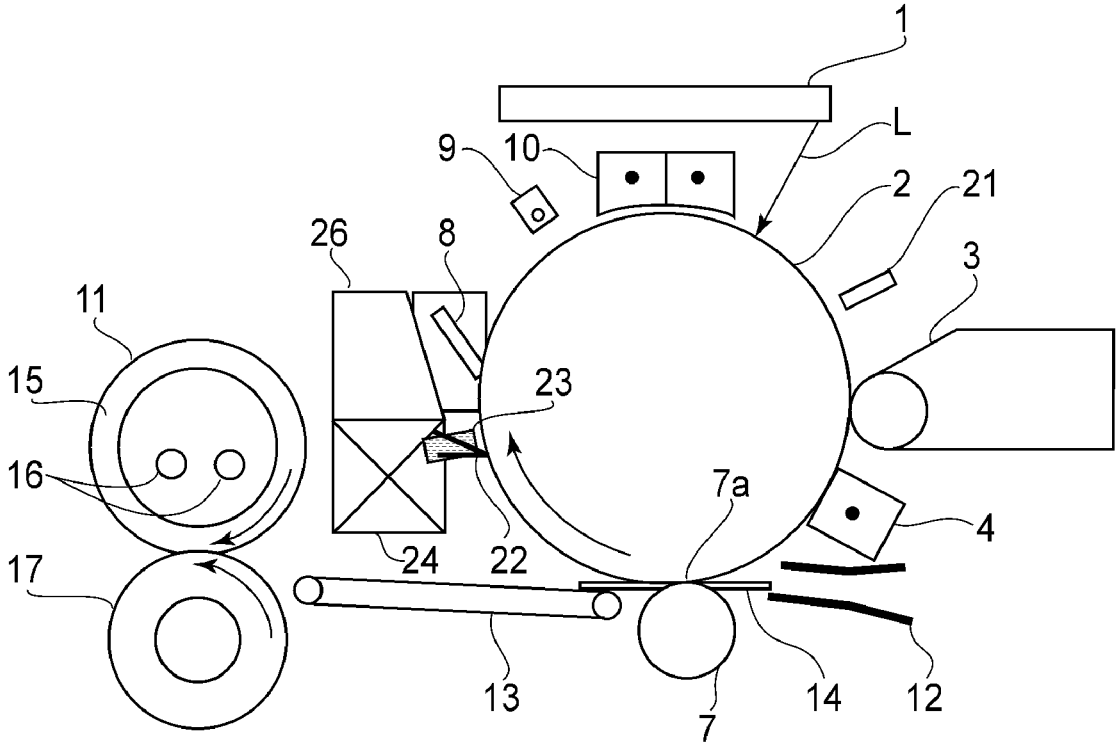
FIG. 2 is a schematic illustration of the image forming apparatus in Embodiment 1 as seen from a side surface side.

FIG. 2 is a schematic illustration showing an image forming apparatus (such as a laser beam printer in this embodiment) according to Embodiment 1 of the present invention.

The image forming apparatus includes a photosensitive drum 2 as an image bearing member rotatable in a direction of an indicated arrow (clockwise direction).

Figure 4:
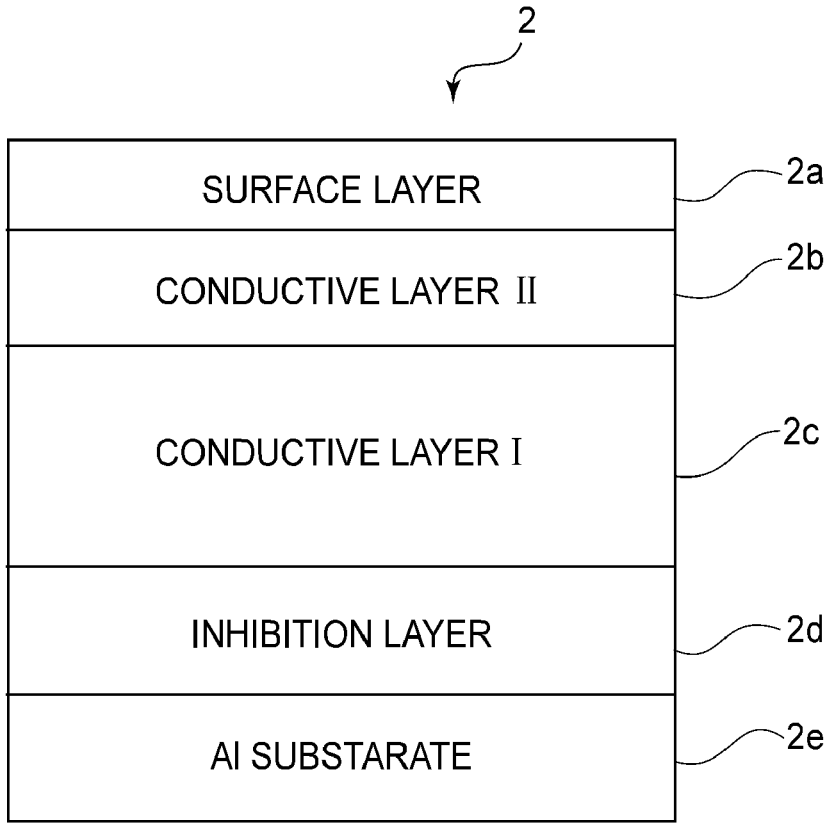
FIG. 4 is a schematic illustration showing a layer structure of a photosensitive drum in Embodiment 1.

The photosensitive drum 2 in this embodiment is formed of a-Si (amorphous silicon) in a diameter 80 mm and is rotationally driven in the arrow direction (clockwise direction) at a predetermined peripheral speed (process speed). The photosensitive drum 2 has, as shown in FIG. 4, a laminated layer structure including a cylindrical substrate (base layer) 2*e* formed of aluminum (electroconductive material), an inhibition layer 2*d*, a photoconductive layer I 2*c*, photosensitive layer II 2*b*, and a surface layer 2*a* in this order from below to above.

The electroconductive layers (I, II) 2*c* and 2*b* are principally formed of an amorphous silicon material containing silicon, hydrogen and halogen. Further, the photosensitive drum 2 has a surface hardness of about 2000 kg/mm$^2$ and has a durable lifetime of 300,000 sheets or more since a primary charger 10 and a pretransfer charger 4 are a corona charger.

Then, an image forming operation of the image forming apparatus will be described.

During image formation, the photosensitive drum 2 is rotationally driven by driving a driving device and the surface thereof is electrically charged to a predetermined polarity and a predetermined potential by the primary charger (charging device) 10 supplied with a charging bias. The charged surface of the photosensitive drum 2 is subjected to imagewise exposure to light L correspondingly to input image information by an exposure device 1, so that a potential of the photosensitive drum 2 surface is lowered at a portion subjected to the imagewise exposure to light L and an electrostatic latent image is formed corresponding to the input image information.

Then, by a developing device 3, toner charged to the same polarity as the charge polarity of the photosensitive drum 2 is deposited on the electrostatic latent image to visualize the electrostatic latent image as a toner image. The toner image then electrically charged by the pretransfer charging device 4, so that the charge polarity of the toner image is further enhanced. Along a conveying path created by a transfer entrance guide 12, a transfer material 14 is conveyed into a transfer nip (transfer position 7*a*) formed between the photosensitive drum 2 and a transfer roller (transfer device) 7. By applying a transfer bias of an opposite polarity to the charge polarity of the toner to the transfer roller 7, the toner image on the image bearing member is transferred onto the transfer material 14.

The transfer material 14 on which the toner image transferred is conveyed into a fixing device 11 by a conveying device 13 provided with a rotary belt. The fixing device 11 is constituted by a fixing roller 15 and a pressing roller 17 and inside the fixing roller 15, a halogen heater as a heat source is disposed. The fixing roller 15 is temperature-controlled at a constant temperature by the halogen heater 16. The transfer material 14 conveyed into a fixing nip formed between the fixing roller 15 and the pressing roller 17 is heated and pressed, so that the toner image is fixed on the transfer material 14 and then the transfer material 14 is discharged to the outside of the image forming apparatus.

On the other hand, untransferred toner remaining on the surface of the photosensitive drum 2 after the toner image transfer is removed and collected by a cleaning device 8 at a cleaning position 8*b* in which a cleaning member 8*a* contacts the photosensitive drum 2 surface. Residual charge on the photosensitive drum 2 surface is removed by a discharging exposure lamp (a discharging device) 9 and the photosensitive drum 2 prepares for a subsequent image forming operation.

Figure 3:
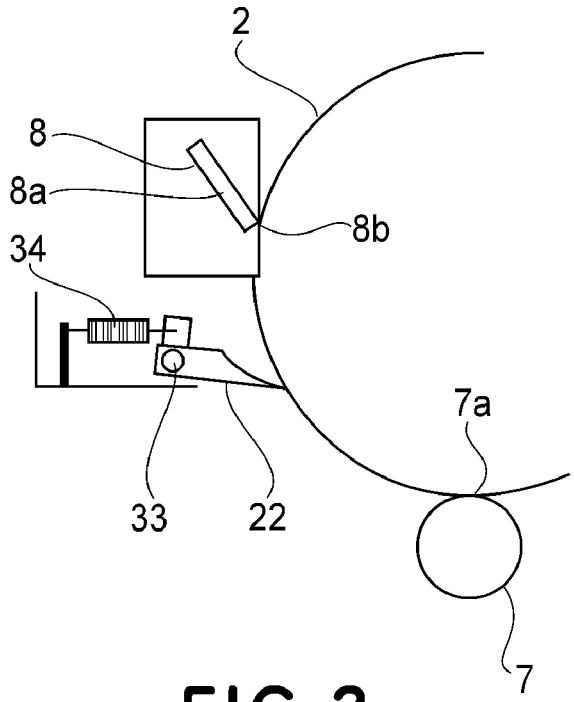
FIG. 3 is a schematic illustration of a separation claw in Embodiment 1.

A separation claw (separating member) 22 is, as shown in FIG. 3, disposed upstream of the transfer position 7*a* and upstream of the cleaning position 8*b*, with respect to a rotational direction of the photosensitive drum 2. The separation claw 22 is provided rotatably about a rotation shaft 33 and is provided with a spring (urging member) 34 at one end thereof and is configured so that an end portion of the separation claw 22 urges against the photosensitive drum 2 surface. By the thus-constituted separation claw 22, the transfer material 14 stuck to the photosensitive drum 2 after passing through the transfer position by an electrostatic force is separated from the photosensitive drum 2.

A density detecting device 23 for detecting a density of a density detecting image for control of an image formed on the photosensitive drum 2 is disposed downstream of the transfer position and upstream of the cleaning position, with respect to the rotational direction of the photosensitive drum 2.

Figure 1:
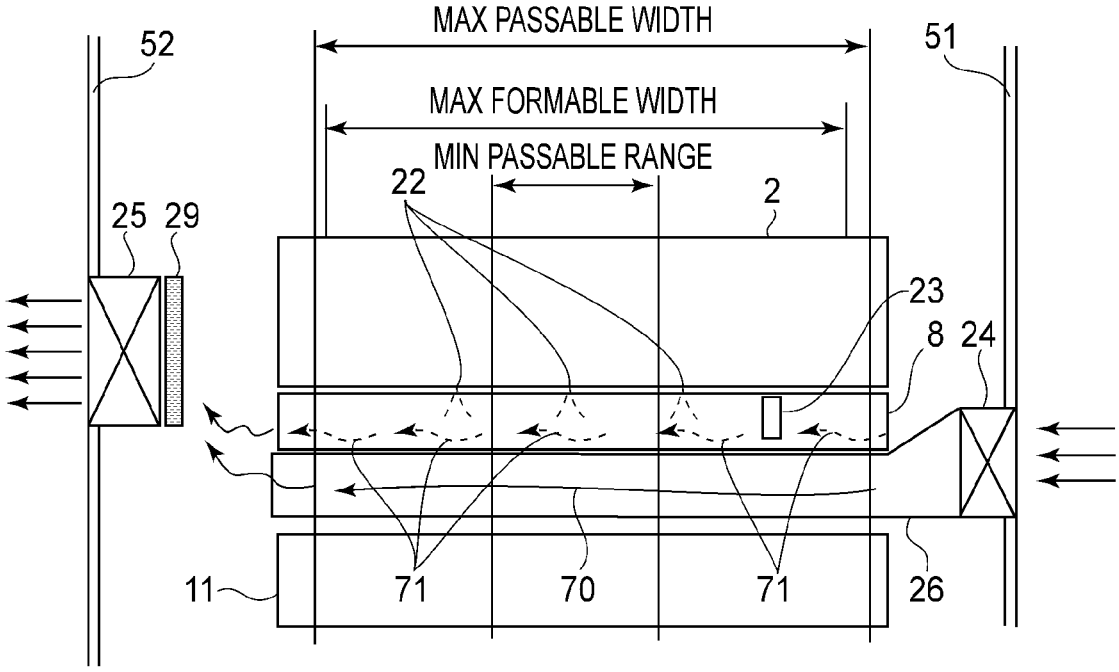
FIG. 1 is a schematic illustration of an image forming apparatus according to Embodiment 1 of the present invention as seen from above.

FIG. 1 is a schematic illustration of the image forming apparatus in this embodiment as seen from above.

The separation claw (separating member) 22 is provided at three positions with a predetermined interval with respect to a direction of a rotation shaft of the photosensitive drum 2. At least one of the separation claws 22 is disposed within a minimum sheet passable width (a width of paper (sheet), having a narrowest width, passable in the image forming apparatus). Further, all the separation claws 22 are disposed within a maximum sheet passage width (a width of paper (sheet), having a widest width, passable in the image forming apparatus).

In this embodiment, for the purpose of, e.g., cooling the inside of the image forming apparatus or exhausting the air from the inside of the image forming apparatus, an air moving device (a suction fan 24 or an exhaust fan 25) for moving the air in the image forming apparatus is provided. The suction fan (air blowing device) 24 is provided to a side plate 51 of a main assembly of the image forming apparatus and outside air sucked in the image forming apparatus by the suction fan 24 is sent into an air duct (air conveying path) 26. The air duct 26 is provided in a space between the cleaning device 8 and the fixing device 11, along the rotational shaft direction of the photosensitive drum 2. The air in the air duct 26 flows in a direction of an indicated arrow 70 in FIG. 1. By the presence of this air duct 26, it is possible to prevent heat from the fixing device 11 from being conducted to the cleaning device 8. As a result, temperature rise of the cleaning device 8 is prevented and thus agglomeration of the collected toner in the cleaning device 8 is prevented. The air coming out of the air duct 26 is exhausted from the inside to the outside of the image forming apparatus by the exhaust fan (air blowing device) 25 provided to a side plate 52 of the apparatus main assembly.

By the action of the exhaust fan 25, the air in an area in which the separation claw 22 located below the bottom surface of the cleaning device 8 is disposed flows in a direction of indicated arrows 71 in FIG. 1 along the photosensitive drum rotational shaft direction, thus being exhausted from the inside to the outside of the image forming apparatus by the exhaust fan 25. The air flowing toward the exhaust fan 25 is subjected to removal of ozone, the toner, and the like when it passes through a filter 29.

Then, control using the density detecting device 23 will be described.

Figure 5:
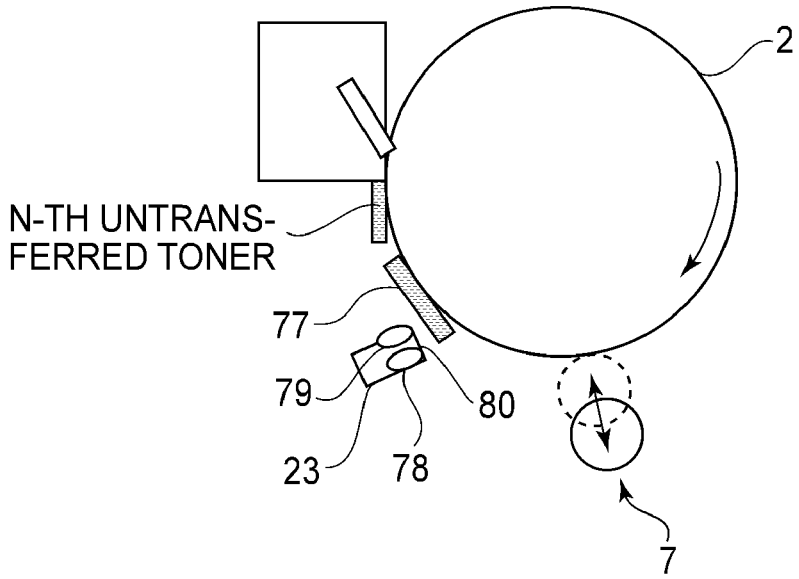
FIG. 5 is a schematic view for illustrating a state of density detection of a density detecting image in Embodiment 1.

FIG. 5 is a schematic view showing a state in which the density detecting device 23 detects a density of a density detecting image 77. The density detecting device 23 is constituted by a light-emitting portion 78 for emitting light and a light receiving portion 79 for receiving reflected light. Based on a light amount detected by the light receiving portion 79, detection of the density of the density detecting image 77 is performed. The image forming apparatus in this embodiment effects formation of the image (density detecting image) for tone gradation control after image formation on a predetermined number of sheets during a continuous image forming operation. The density detecting image is formed by forming a predetermined electrostatic latent image on the photosensitive drum 2 and developing the electrostatic latent image with the toner by the developing device 3. Before this tone gradation control, the transfer roller 7 contacting the photosensitive drum 2 is separated from the photosensitive drum 2 and then the control is stated in a state in which the influence of the transfer roller 7 is eliminated.

Figure 6:
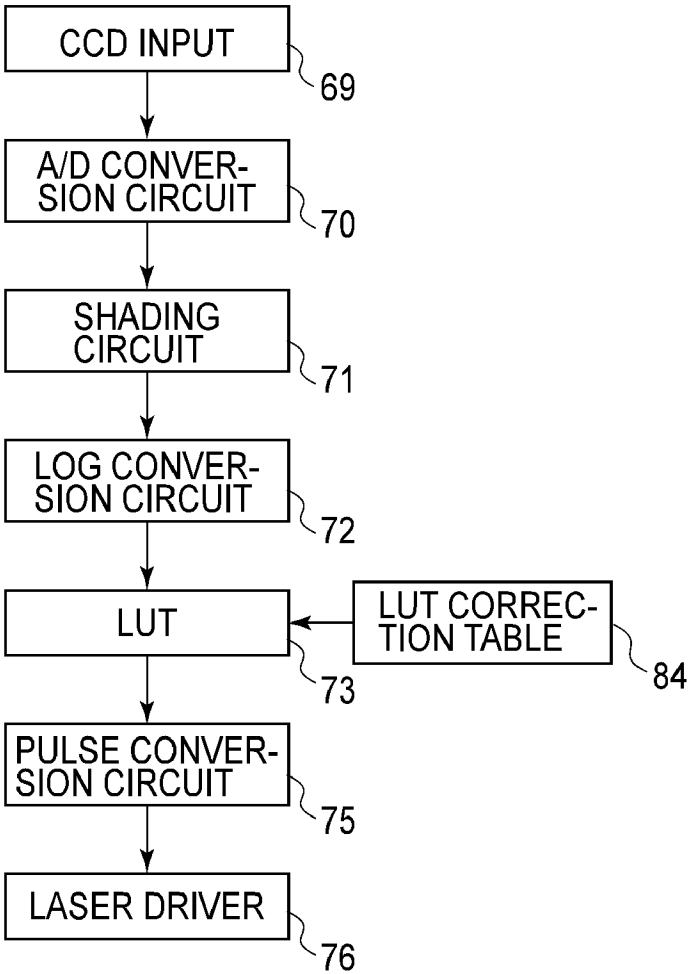
FIG. 6 is a block diagram of tone gradation control in Embodiment 1.

Then, constitution of the image control will be described by using a block diagram of a tone gradation image reproducing process shown in FIG. 6.

A luminance signal of the image is obtained by CCD input 69 and is converted into a digital luminance signal by an A/D conversion circuit 70. The luminance signal passes through a shading circuit 71 for correcting sensitivity variation of individual CCD elements and then passes through an LOG converter 72 for converting the corrected luminance signal into a density signal.

The density signal obtained by the LOG converter 72 is converted on the basis of an LUT 73 to be corrected so that a γ characteristic of a printer with respect to an original image density at the time of initial setting coincides with that with respect to an output image density. This LUT 73 is corrected by an LUT correction table 84 prepared based on a computation result described later.

The signal converted by the LUT 73 is converted into a signal corresponding to a dot width by a pulse width conversion circuit 75 and then is sent to a laser driver 76. Through such a digital signal processing, an electrostatic latent image having a tone gradation characteristic depending on a dot area change is formed on the photosensitive drum by laser scanning and is developed to obtain a tone gradation control image (density detecting image).

Figure 7:
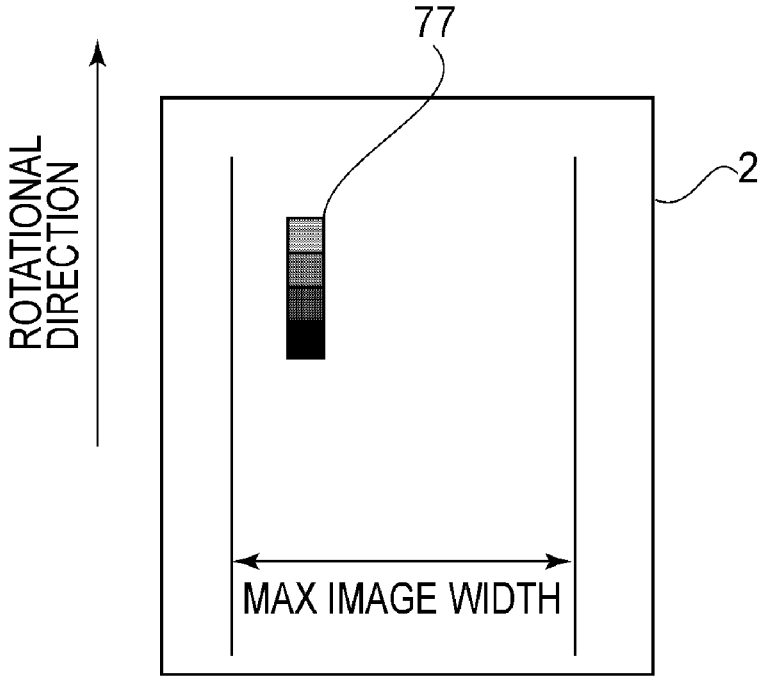
FIG. 7 is a schematic view showing a tone gradation pattern image in Embodiment 1.

In this embodiment, the above-described density signal level is 8 bits, i.e., has 256 tone gradation levels. By a test pattern generator, the electrostatic latent image is formed at four levels of 40H, 80H, COH and FFH. Specifically, as shown in FIG. 7, a tone gradation pattern image 77 includes four square pattern images with the above four levels. Each of the four square pattern images has a size of 25 mm×25 mm and is successively formed on the photosensitive drum 2. The image forming apparatus contains the test pattern generator for outputting several different density signal levels on the photosensitive drum 2. An output of each tone gradation control pattern, of the control image 77 formed on the photosensitive drum, corresponding to an associated toner optical density, is detected by the density detecting device 23 with synchronized timing. A tone gradation pattern forming position is located within the maximum image formation width and the density detecting device 23 is disposed on the photosensitive drum 23 correspondingly to the tone gradation pattern.

Figure 8:
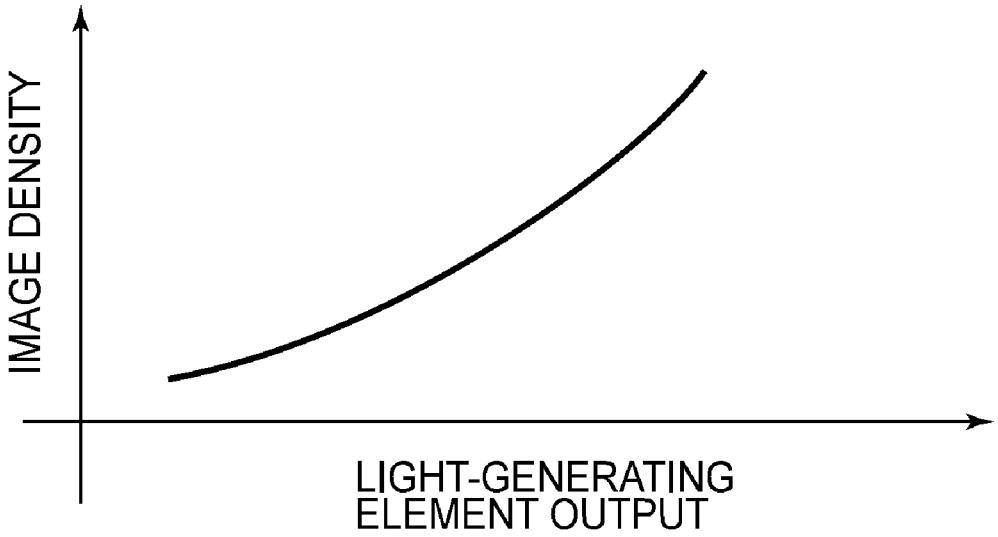
FIG. 8 is a graph showing an output relationship between an image density and a light receiving element in Embodiment 1.

FIG. 8 is a graph showing a relationship between an output image density and an output of the light receiving element (light receiving portion) 79 in this embodiment. It is understood that there is a tendency that the detection image density is higher with a larger output of the light receiving element.

Next, a constitution for preparing the LUT correction table 84 by processing a detection signal read by the light receiving element 79 will be described. The signal read by the light receiving element 79 is converted into a digital signal by the A/D converter 70 and then is converted into a density signal by a density conversion circuit 81.

Figure 10:
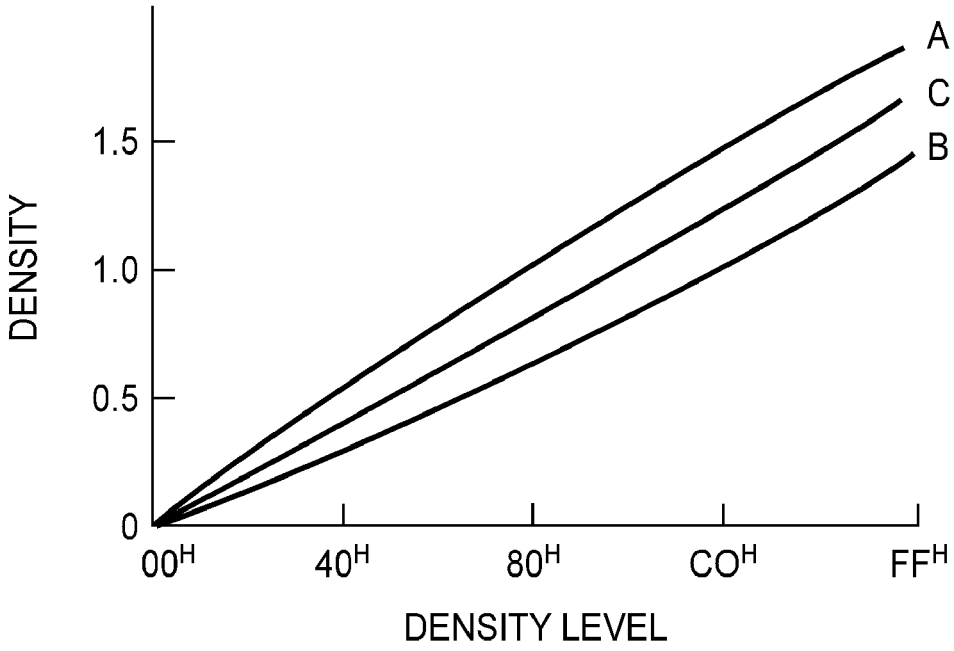
FIGS. 10 and 11 are graphs each showing a relationship between an input density level and an output density level in Embodiment 1.

Values of the image density corresponding to the respective density levels of the tone gradation control pattern image 77 are set so that they are represented by a curve C shown in FIG. 10 at the time of initial setting. However, due to a supply state, an environment, a change with time, and the like of the toner, a developing characteristic, a sensitivity of the photosensitive drum, and the like are changed, so that the image density values corresponding to the respective density levels can be changed from the initially set curve C shown in FIG. 10 to a curve A or a curve B.

Figure 11:
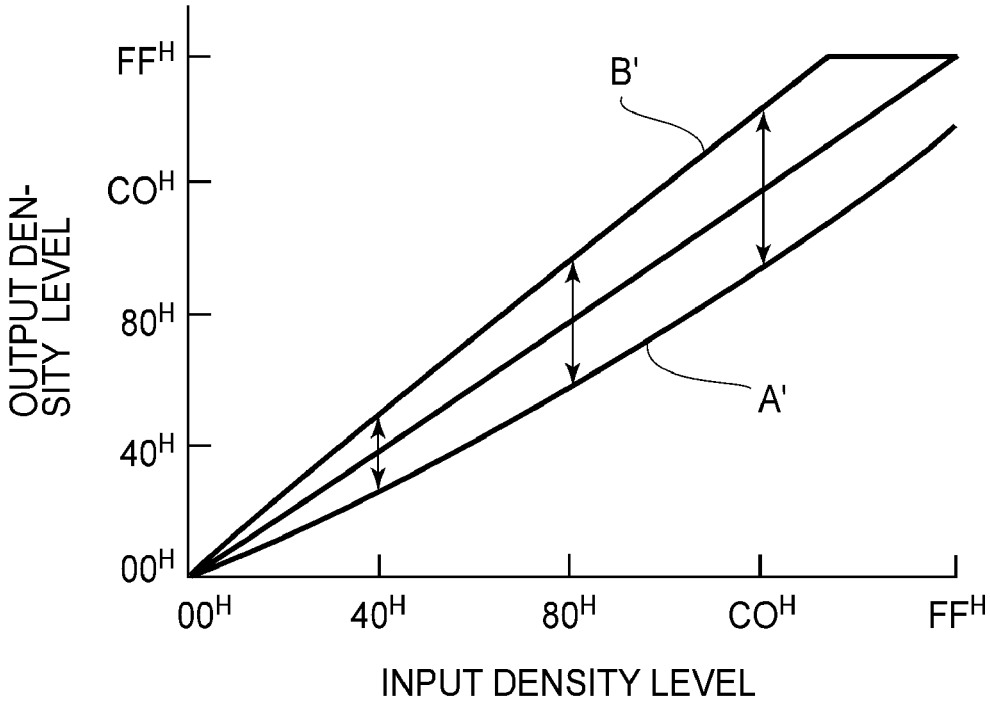

Therefore, when the detection result of the image density obtained from the light receiving element 79 is represented by the curve A higher in level than the initially set value curve C as shown in FIG. 10, correction computation is made so that an output level is lowered from the set value by a difference between the higher value and the set value as shown by a curve A' in FIG. 11. On the other hand, when the detect in result is represented by the curve B lower in level than the initially set value curve C as shown in FIG. 10, the correction computation is made so that the output level is increased from the set value by a difference between the set value and the lower value as shown by a curve B' in FIG. 11.

Figure 9:
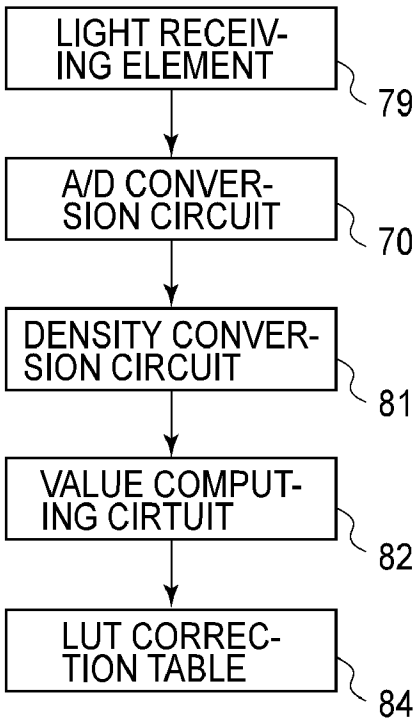
FIG. 9 is a constitution block diagram for preparing an LUT correction table in Embodiment 1.

For this purpose, from the image density values calculated by the density conversion circuit 81 shown in FIG. 9, through the correction value computing circuit 82 for effecting correction value computation as described above, the LUT correction table 84 for correcting the LUT 73 is prepared.

By correcting the LUT 73 through the LUT correction table 84 obtained as described above, the changed printer tone gradation characteristic is corrected, so that it is possible to obtain an always constant tone gradation characteristic. Incidentally, the above-described correction values are stored in an RAM of a control portion (not shown) and are used until the above-described correction is made again when the tone gradation characteristic is judged as being improper.

In the case where the image control using the density detecting device 23 is effected, the density detecting device 32 can cause a malfunction by the influence of the presence of suspended toner in the neighborhood of the density detecting device 23. In the case where the toner is deposited in the neighborhood of the light receiving portion, although the image density is actually kept at a normal level represented by the curve as shown in FIG. 10, the density detecting device 23 judges the image density as being lower than the actual image density. As a result, the density detecting device 23 judges the image density level as, e.g., that represented by the curve B, so that the correction computation as represented by the curve B' is carried out. As a result, an actually output image becomes an image darker than an assumed image.

In order not to cause such a malfunction, in this embodiment, as shown in FIG. 1, the density detecting device 23 is disposed upstream of the separation claw 22 with respect to an air movement direction in the image forming apparatus. In this embodiment, the density detecting device 23 is disposed at the same level (height) as that of the separation claw 22.

Figure 12:
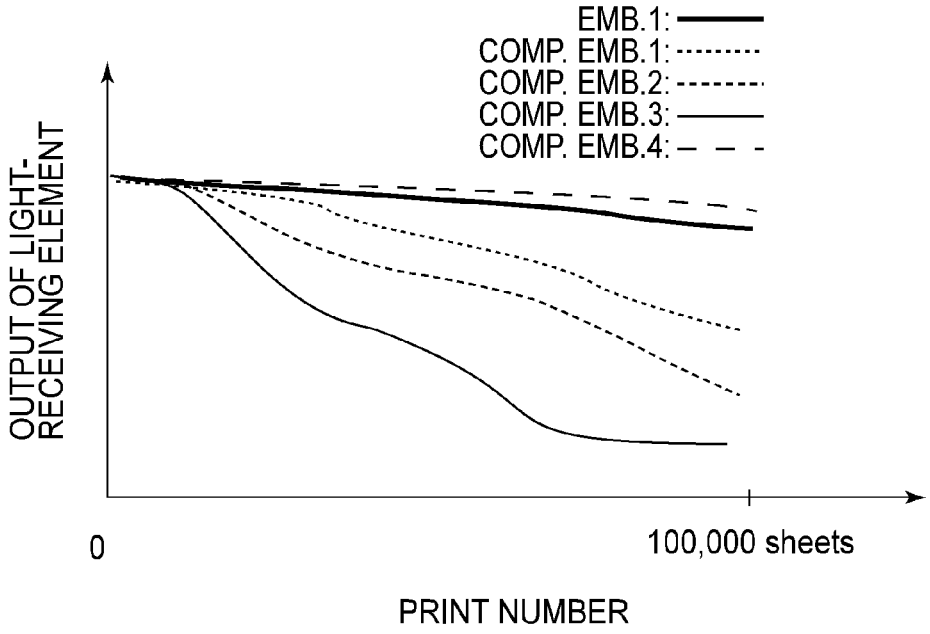
FIG. 12 includes a table and a graph for confirming light receiving sensitivity of a density detecting means depending on the number of sheets subjected to continuous image formation in Embodiment 1 and Comparative Embodiments 1 to 4.

Here, a result of study on an actual sheet passing durability test (comparative experiment) with respect to this embodiment (Embodiment 1) and Comparative Embodiments 1 to 4 is shown in FIG. 12. FIG. 12 includes a table showing conditions for the respective embodiments and a graph showing a relationship between the number of sheets subjected to a continuous sheet passing (image formation) taken as an abscissa and an output of the light receiving element of the density detecting device taken as an ordinate.

The comparative experiment is summarized as follows. In each of the embodiments, an image with a print ratio of 5% was continuously formed on A4-sized sheets until the print number reaches 100,000 sheets to effect the durability test. During this durability test, a change in output of the light receiving element of the density detecting device 23 was investigated.

Figure 13:
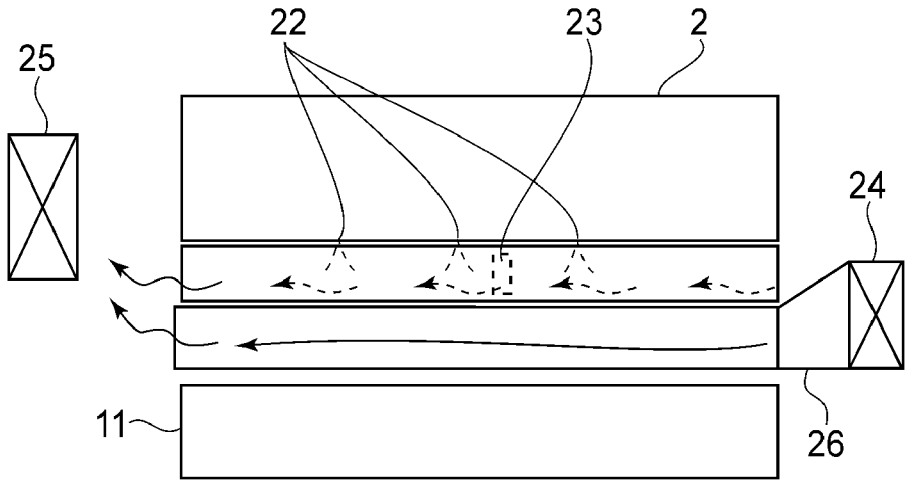
FIG. 13(*a*) is a schematic illustration showing a constitution in Comparative Embodiment 1 and FIG. 13(*b*) is a schematic illustration showing a constitution in Comparative Embodiment 2.
Figure 13:
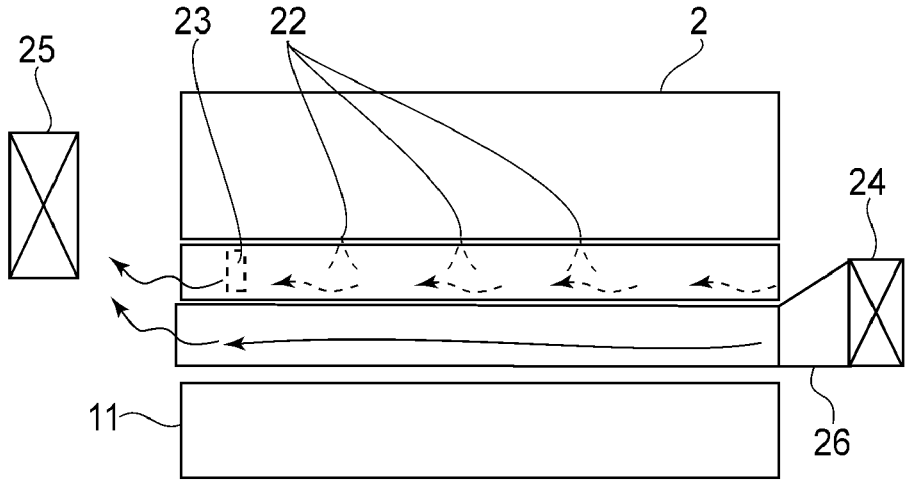

In Comparative Embodiment 1, as shown in FIG. 13(*a*), the density detecting device 23 was disposed between a center separation claw and a right separation claw. Other constitutions are identical to those in Embodiment 1.

In Comparative Embodiment 2, as shown in FIG. 13(*b*), the density detecting device 23 is disposed downstream of the three separation claws 22 with respect to the air movement direction. Other constitutions are identical to those in Embodiment 1.

In Comparative Embodiment 3, in a state in which the density detecting device 23 was disposed at the same position as that in Embodiment 1, an operation of the exhaust fan 25 was stopped to prevent movement of the air in the image forming apparatus and then the durability test was performed.

Figure 14:
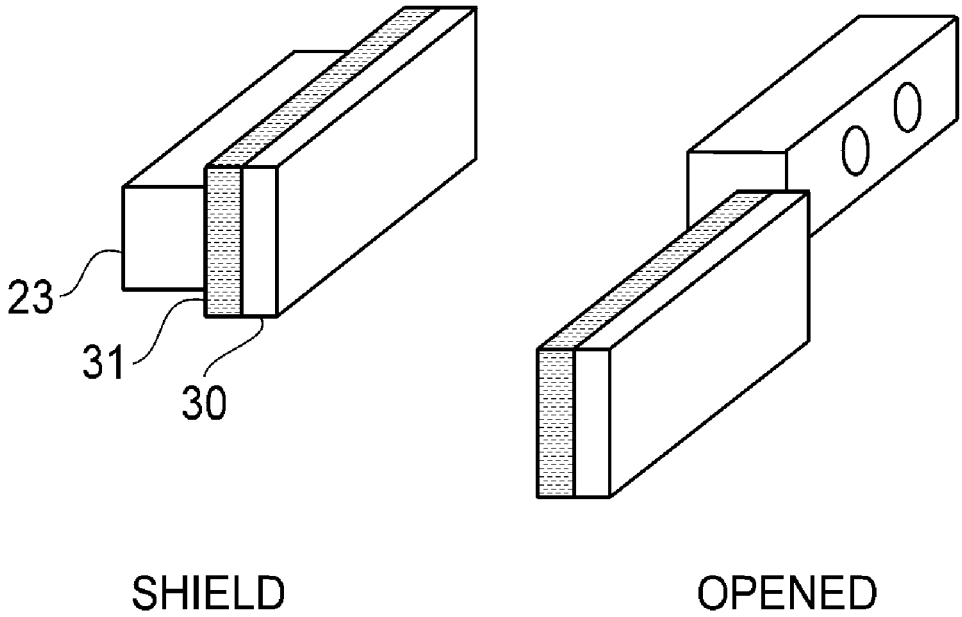
FIG. 14 is a schematic illustration showing a shielding member in Comparative Embodiment 4.

In Comparative Embodiment 4, the density detecting device 23 was disposed at the same position as that in Comparative Embodiment 2 and a shielding member 30 as shown in FIG. 14 was provided to the density detecting device 23. This shielding member 30 covers the light-emitting portion and the light receiving portion of the density detecting device 23 with a surface of a sponge member 31 provided to the shielding member 30 during the image formation. On the other hand, during the density detecting operation, the shielding member 30 is removed to expose the light-emitting portion and the light receiving portion.

From the graph in FIG. 12, it is found that the change in output of the light receiving element with the print number is different among the respective embodiments. When surfaces (detection surfaces 80) of the respective density detecting device 23 after the durability test were observed, it was found that the output of the light receiving element was lowered depending on the degree of toner deposition on the detection surface. That is, it was found that there was a correlation between the output of the light receiving element and the toner deposition onto the surface of a sensor of the density detecting means.

From the graph in FIG. 12, it is understood that the upstream-side position of the density detecting device 23 is advantageous rather than the downstream-side position of the density detecting device 23 with respect to the separation claw 22 in the air movement direction when the exhaust fan 25 is in operation, as a result of Embodiment 1, Comparative Embodiment 1 and Comparative Embodiment 3. For example, when the density detecting device 23 is disposed between the separation claws as in Comparative Embodiment 2, the density detecting device 23 is adversely affected by the scattering toner from the upstream-side separation claw, thus being disadvantageous compared with that in Embodiment 1.

The density detecting device 23 in Comparative Embodiment 3 provided the worst result in terms of the toner contamination. This may be attributable to such a phenomenon that when the air in the apparatus is not moved, the suspended toner in the apparatus is always increased without flowing out of the apparatus and is not moved from the neighborhood of the sensor.

Further, from comparison between Embodiment 1 and Comparative Embodiment 4, it is found that according to Embodiment 1, it is possible to achieve the same performance as the case where the shielding member in Comparative Embodiment 4 is disposed. However, in Comparative Embodiment 4, the shielding member and its driving mechanism are needed, so that an apparatus constitution is complicated. On the other hand, in Embodiment 1, the prevention of the toner contamination can be realized with a simple constitution.

As described above, by disposing the density detecting device upstream of the separation claw with respect to the air movement direction, the scattering toner from the separation claw is not moved toward the density detecting device but is moved toward the downstream side with respect to the air movement direction. As a result, the amount of the tone suspended in the neighborhood of the density detecting device is largely decreased, so that the amount of the toner deposited on the sensor surface is decreased. As a result, a durable lifetime of the sensor can be considerably prolonged.

Embodiment 2

Another embodiment according to the present invention will be described specifically with reference to the drawing.

In this embodiment, the constitution of the image forming apparatus is basically the same as that in Embodiment 1 and members or portions having the same functions as those in Embodiment 1 are represented by the same reference numerals or symbols, thus being omitted from redundant description unless needed specifically.

Figure 15:
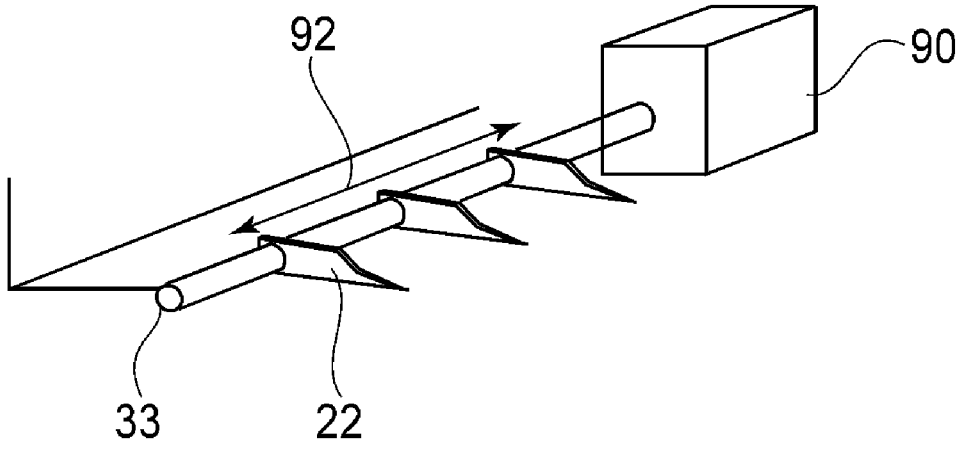
FIG. 15 is a schematic illustration showing a constitution of a separation claw in Embodiment 2.

In this embodiment, in addition to the constitution in Embodiment 1, as shown in FIG. 15, a rotatable supporting member 33 for holding the separation claws 22 is configured to be reciprocable in a direction of a rotation shaft of the photosensitive drum 2 (in a direction indicated by an arrow 92 in FIG. 15) by an reciprocal movement device 90. The reciprocal movement device 90 can be constituted by, e.g., an eccentric cam, an eccentric crank, or the like as described in, e.g., JP-A Sho 63-28687.

During the image formation, the rotatable supporting member 33 is configured to be always subjected to reciprocating motion by a constant distance. By subjecting the separation claw 22 contacting the surface of the photosensitive drum 2 to the reciprocating motion, it is possible to reduce a damage on the photosensitive drum 2 surface occurred due to rubbing with the separation claw at one position.

By the reciprocating motion of the separation claw in the above-described constitution, the toner accumulated on the separation claw is move liable to be separated. The separated and suspended toner has a larger particle size than that of the scattering toner from the untransferred toner, so that in the case where the toner is deposited on the surface of the density detecting device 23, the toner can cause a remarkable lowering in output of the light receiving element. Also in such a constitution, by employing the constitution of Embodiment 1, it is possible to effectively prevent the toner contamination of the density detecting device.

Embodiment 3

Embodiment 3 according to the present invention will be described with reference to the drawings.

In this embodiment, members or portions having the same functions as those in Embodiment 1 are represented by the same reference numerals or symbols, thus being omitted from redundant description unless needed specifically.

Figure 17:
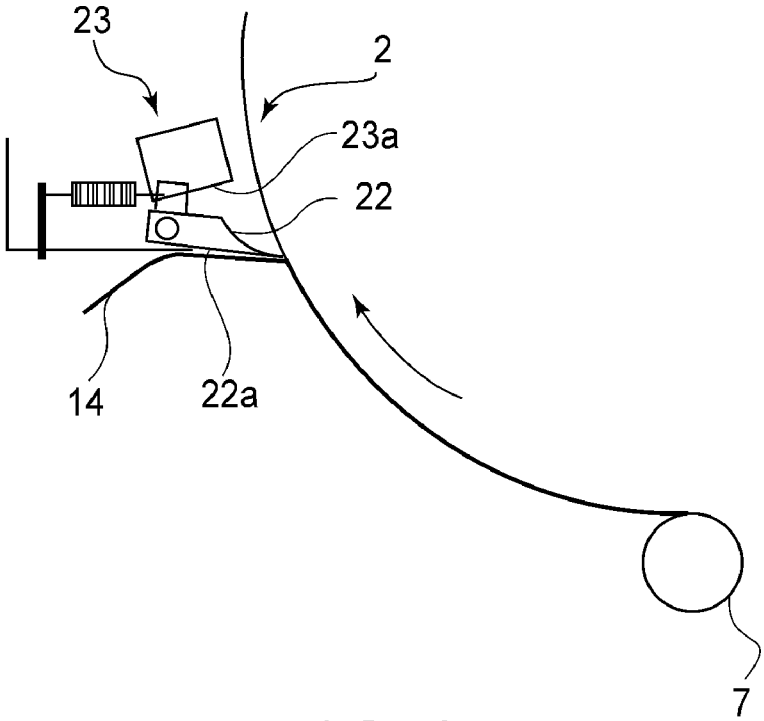
FIG. 17 is a schematic illustration showing an arrangement of the separation claw and the density detecting means in Embodiment 3.

In this embodiment (Embodiment 3), similarly as in Embodiment 1, with respect to the air movement direction, the density detecting device is disposed upstream of the separation claw. As a result, it is possible to prevent the toner contamination of the density detecting device effectively. In this embodiment, as shown in FIG. 17, a lower surface 23*a* of the density detecting device 23 is disposed downstream of a lower surface 22*a* of the separation claw 22 with respect to the rotational direction of the photosensitive drum (image bearing member) 2. That is, with respect to the image bearing member rotational direction, the upstream-side surface 23*a* of the density detecting device 23 is disposed downstream of the upstream-side surface 22*a* of the separation claw 22.

Generally, the suspended toner in an area between the transfer position and the cleaning position is moved toward the rotational direction downstream side by the flow of the air caused by the rotation of the photosensitive drum 2. In order to avoid the deposition of the suspended toner, it is considered to be effective in preventing the toner contamination (toner deposition) that the density detecting device 23 is disposed upstream of the separation claw 22 with respect to the rotational direction of the photosensitive drum 2 to the extent possible.

However, when the density detecting device 23 is disposed upstream of the separation claw 22 with respect to the photosensitive drum 2 rotational direction, it has been confirmed that the following problem has arisen.

Figure 16:
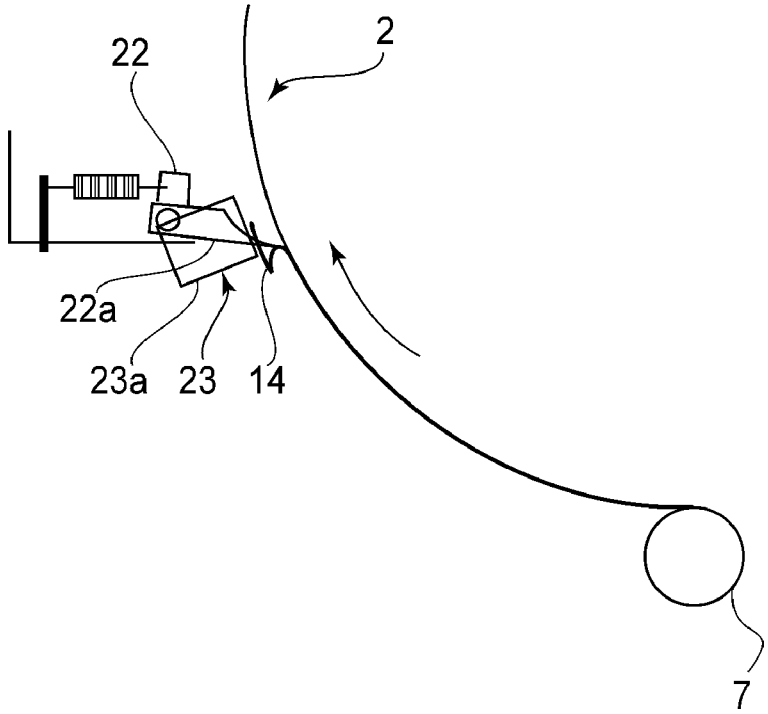
FIG. 16 is a schematic illustration showing an arrangement of the separation claw and the density detecting means in a comparative embodiment to be compared with Embodiment 3.

In the case where the image formation with paper having low rigidity such as thin paper is effected, even when the separation claw is used, there arises a situation of a poor separation property from the photosensitive drum. In this case, in the apparatus shown in FIG. 16, a leading end of paper placed in a poor separation state contacts and is caught by the density detecting device 23, thus causing paper jamming.

This problem can be solved by the constitution of Embodiment 3.

That is, as shown in FIG. 17, with respect to the image bearing member rotational direction, the upstream-side surface 23*a* of the density detecting device 23 is disposed downstream of the upstream-side surface 22*a* of the separation claw 22. By this constitution, even when there arise such a situation that the paper is less liable to be separated, the leading end of the paper is not caught by the density detecting device 23. Therefore, it is possible to prevent an occurrence of the paper jamming.

Thus, according to the constitution of Embodiment 3, it is possible to simultaneously prevent the paper jamming in addition to the prevention of the toner contamination of the density detecting device.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 256415/2008 filed Oct. 1, 2008, which is hereby incorporated by reference.

What is claimed is:

1. An image forming apparatus comprising:

a rotatable image bearing member on which a toner image is to be formed;

a transferring device for transferring the toner image onto a transfer material at a transfer position;

a separating member, disposed downstream of the transfer position with respect to a rotational direction of said image bearing member so as to contact said image bearing member, for separating the transfer material from said image bearing member;

a density detecting device, disposed downstream of the transfer position with respect to the rotational direction of said image bearing member, for detecting a density of an image for density detection formed on said image bearing member; and an air moving device for moving air in said image forming apparatus in a direction of a rotation shaft of said image bearing member;

wherein said density detecting device is disposed upstream of said separating member with respect to a direction of air movement by said air moving device.

2. An apparatus according to claim 1, wherein with respect to the rotational direction of said image bearing member, said density detecting device has an upstream-side surface disposed downstream of an upstream-side surface of said separating member.

3. An apparatus according to claim 1, further comprising a cleaning device for collecting untransferred toner on said image bearing member at a cleaning position, and wherein said separating member and said density detecting device are disposed downstream of the transfer position and upstream of the cleaning position with respect to the rotational direction of said image bearing member.

4. An apparatus according to claim 1, further comprising a fixing device for heating the transfer material on which the toner image is transferred, and wherein said air moving device moves the air between said image bearing member and said fixing device.

* * * * *